US006544356B2

(12) United States Patent
Katagiri et al.

(10) Patent No.: US 6,544,356 B2
(45) Date of Patent: Apr. 8, 2003

(54) STEEL SHEET FOR USE AS AN ELECTRODE-SUPPORTING FRAME MEMBER OF A COLOR PICTURE TUBE AND MANUFACTURING METHOD THEREOF

(75) Inventors: Yukio Katagiri, Kure (JP); Akito Kawamoto, Kure (JP); Seiichi Hamanaka, Kure (JP); Nobuo Ozawa, Gifu-ken (JP); Takahide Sanma, Gifu-ken (JP)

(73) Assignees: Nisshin Steel Co., Ltd. (JP); Sony Corporation (JP)

( * ) Notice: Subject to any disclaimer, the term of this patent is extended or adjusted under 35 U.S.C. 154(b) by 0 days.

(21) Appl. No.: 09/731,562

(22) Filed: Dec. 7, 2000

(65) Prior Publication Data

US 2001/0000580 A1 May 3, 2001

Related U.S. Application Data

(63) Continuation of application No. 09/085,538, filed on May 27, 1998, now abandoned.

(30) Foreign Application Priority Data

Dec. 5, 1996 (JP) ..... 8-325667

(51) Int. Cl.[7] ..... C22C 38/24

(52) U.S. Cl. ..... 148/333; 148/334; 148/336

(58) Field of Search ..... 148/333, 334, 148/336

(56) References Cited

U.S. PATENT DOCUMENTS 4,897,519 A 1/1990 Clark et al. ..... 219/76.14

FOREIGN PATENT DOCUMENTS

| | | |
|---|---|---|
| EP | 0332875 | 9/1989 |
| FR | 2740715 | 5/1997 |
| JP | 59173244 | 10/1984 |
| JP | 63230854 | of 1988 |
| JP | 08067945 | 3/1996 |
| JP | 10046295 | 2/1998 |
| SU | 559796 | of 1977 |
| WO | 96/13618 | of 1996 |

OTHER PUBLICATIONS

Japanese Industrial Standard No. Z 2201, "Test Pieces for Tensile Test for Metallic Materials," *JSA*, UDC 620.115.8:620.172:69, 18 pp. (1998) English–language translation.

Japanese Industrial Standard No. Z 2241, "Method of tensile test for metallic materials," *JSA*, UDC 620.172:669, 10 pp. (1993) English–language translation.

Japanese Industrial Standard No. Z 2272, "Method of tensile creep rupture test for metallic materials," *JSA*, UDC 620.172.251.2:669, 7 pp. (1993) English–language translation.

*Primary Examiner*—Sikyin Ip
(74) *Attorney, Agent, or Firm*—Webb Ziesenhiem Logsdon Orkin & Hanson P.C.

(57) ABSTRACT

A steel sheet has composition consisting of 0.003–0.10 wt. % C, not more than 1.0 wt. % Si, 0.05–1.5 wt. % Mn, not more than 0.10 wt. % P, not more than 0.02 wt. % S, 1.5–8.0 wt. % Cr, 0.003–0.10 wt. % Al, at least one of 0.08–0.40 wt. % Ti, 0.08–0.40 wt. % Nb and 0.08–0.40 wt. % V, optionally at least one of Cu up to 2.0 wt. %, Ni up to 2.0 wt. %, 0.01–2.0 wt. % Mo, 0.01–2.0 wt. % W and 0.0003–0.0050 wt. % B and the balance being essentially Fe except inevitable impurities. The steel sheet is good of both a room-temperature strength and a high temperature strength. The new steel sheet is useful as a frame member of a color picture tube for stretching color selecting electrode elements, instead of an expensive ferritic stainless steel.

2 Claims, 1 Drawing Sheet

STEEL SHEET FOR USE AS AN ELECTRODE-SUPPORTING FRAME MEMBER OF A COLOR PICTURE TUBE AND MANUFACTURING METHOD THEREOF

CROSS-REFERENCE TO RELATED APPLICATION

This application is a continuation of U.S. patent application Ser. No. 09/085,538, filed May 27, 1998, now abandoned.

BACKGROUND OF THE INVENTION

1. Field of the Invention

The present invention relates to a high-strength steel sheet for use as an electrode-supporting frame member installed in an aperture grill-type color picture tube and also relates to a manufacturing method thereof.

2. Prior Art

An aperture grill type color picture tube has color selecting electrode elements each made of a thin metal sheet in which striped slits for passage of electron beams are formed at positions corresponding to matrix of RGB (red, green and blue) phosphors arranged on a phosphor screen in order to excite the RGB phosphors with electron beams discharged from an electron gun. The color selecting electrode elements are stretched to and supported with an electrode-supporting frame member.

RGB phosphors on the phosphor screen are selectively irradiated and excited by scanning with electron beams, so as to display a color image composed of red, green and blue colors. Directions of electron beams are likely affected by terrestrial magnetism or the like at the surroundings. If electron beams are deflected by the magnetisms, the color image can not be accurately reproduced. Influence of the terrestrial magnetism or the like can be inhibited by covering the color picture tube with a magnetic shield.

The electrode-supporting frame member installed in the color picture tube is also affected by the terrestrial magnetism or the like, so that its material is important to improve performance of the color picture tube.

The electrode-supporting frame member shall assure location of the slits formed in the color selecting electrode elements for passage of electron beams at accurate positions corresponding to the matrix of phosphors, in order to precisely direct electron beams to each of the RGB phosphors. If the color selecting electrode elements stretched to the electrode-supporting frame member are deviated from predetermined positions due to thermal expansion or the like, the electron beams are not directed to selected phosphors. The mal-direction of the electron beams impedes accurate reproduction of a color image.

The electrode-supporting frame member for supporting the color selecting electrode elements is made from a steel sheet of 2–7 mm in thickness formed into a predetermined shape necessary in response to a size of the color picture tube. An electrode-supporting frame member for a small-sized color picture tube is manufactured by press forming, while an electrode-supporting frame member for a big-sized color, picture tube is commonly manufactured by roll-forming or press-forming a steel sheet at its edges corresponding to four sides of the frame and then fabricating the formed steel sheet to a frame shape fly welding. The electrode-supporting frame member is thereafter stress-relief annealed.

As for the color selecting element, a cold-rolled steel sheet of 0.08–0.15 mm in thickness is etched to form striped slits for passage of electron beams. The etched steel sheet is welded to upper and lower parts of the electrode-supporting frame member which is pressed inwards. After the electrode elements are fixed to the frame member, pressure is removed from the frame member. As a result, the frame member exhibits a reaction force for stretching the electrode elements, due to removal of the pressure. In this way, the electrode elements are fabricated with the frame member.

The frame member integrated with the electrode elements is then subjected to blackening treatment, in order to suppress such defects as heat radiation, generation of secondary electrons and rusts. An oxide film is formed on the frame member by the blackening treatment. The oxide film shall be firmly adhered onto the frame; otherwise oxide particles originated in peeling-off of the black oxide film would scatter in the color picture tube and significantly deteriorate performance of the color picture tube.

In the aforementioned manufacturing process, after the electrode elements are integrated with the frame member, the frame member is subjected to a heat cycle of the blackening treatment under the condition that a bending stress for stretching the electrode elements is applied to the frame member. A tensile force for stretching the electrode elements is reduced due to stress relaxation of both the frame member and the electrode elements which were heated at a high temperature during the blackening treatment.

The structure formed when the electrode elements are stretched to the frame member by application of the tensile force aims at maintaining accurate positional relationship of the electrode elements by the applied tensile force. The tensile force absorbs elongation of the electrode members and eliminates color dislocation, even when the electrode elements are heated and thermally expanded due to radiation with electron beams. However, reduction of the stretching tensile force caused by the blackening treatment weakens function of the frame member and often causes occurrence of color dislocation. Especially, the aperture grill-type color picture tube is likely affected by vibrations due to the striped slits for passage of electron beams which are formed in the electrode elements. When the stretching tensile force is reduced to a certain degree, the electrode elements resonate with acoustic waves from a speaker and cause occurrence of color dislocation.

The frame member is thermally expanded when the electrode elements are heated at a higher temperature. The thermal expansion also causes occurrence of color dislocation.

In this regard, a high-Cr ferritic stainless steel has been used as material for an electrode-supporting frame member, since it is resistant to reduction of a stretching tensile force necessary for the frame member and has a small thermal expansion coefficient. But, use of the ferritic stainless steel causes an increase in a cost of the frame member for a color picture tube.

The inventors proposed an alloyed steel which is cheaper than the ferritic stainless steel, as disclosed in Japanese Patent Application Laid-Open 8-67945. The proposed steel contains 0.01–1.0 wt. % Mo and not more than 2.0 wt. % Cu to improve tensile strength both at a room temperature and a high temperature. Since the steel contains only 3.0 wt. % or less Cr, it is used as a cheaper material instead of a ferritic stainless steel for an electrode-supporting frame member.

By the way, there is a tendency to produce a big-sized color picture tube in these days. Color selecting electrode elements as well as an electrode-supporting frame member become large in size to cope with the size of the color picture tube. Since affections of a stretching tensile force and thermal expansion are greater with enlargement of a frame member in size, it has been inevitable to design a big and heavy electrode-supporting frame member in order to endure the reduction of the stretching tensile force or the thermal expansion.

Taking into consideration the aforementioned properties necessary for an electrode-supporting frame member, there is a strong demand for provision of a new material for the frame member which is improved in strength enough to enable fabrication of an enlightened frame member, good of formability and cheap, and hardly reduces a stretching tensile force.

SUMMARY OF THE INVENTION

The present invention aims at provision of such a material, which is cheap, exhibits high strength and hardly reduces a tensile force for stretching color selecting electrode elements even after being subjected to a heat cycle of blackening treatment, and is suitable for use as an electrode-supporting frame member. The object of the present invention is to provide an inexpensive Cr steel sheet which is excellent in strength and formability and has properties necessary for an electrode-supporting frame member instead of an expensive ferritic stainless steel.

A high-strength steel sheet for use as an electrode-supporting frame member according to the present invention consists of 0.003–0.10 wt. % C, not more than 1.0 wt. % Si, 0.05–1.5 wt. % Mn, not more than 0.10 wt. % P, not more than 0.02 wt. % S, 1.5–8.0 wt. % Cr, 0.003–0.10 wt. % Al, and one or more selected from 0.08–0.40 wt. % Ti, 0.08–0.40 wt. % Nb and 0.08–0.40 wt. % V, and the balance being essentially Fe except inevitable impurities. The steel sheet may further contain one or more of Cu up to 2.0 wt. %, Ni up to 2.0 wt. %, 0.01–2.0 wt. % Mo, 0.01–2.0 wt. % W and 0.0003–0.0050 wt. % B.

The steel sheet is manufactured as follows: A slab having the specified composition is hot-rolled at a finishing temperature of 820–950° C. and a coiling temperature of 400–700° C. A hot-rolled steel strip is skin-pass rolled and then pickled, or the hot-rolled steel strip is pickled and then skin-pass rolled. The steel sheet may be also manufactured by: hot-rolling a slab having the specified composition at a finishing temperature of 820–950° C., and coiling temperature of 400–700° C., pickling the hot-rolled steel strip, cold-rolling the pickled steel strip, finally annealing the cold-rolled steel strip and then skin-pass rolling the annealed steel strip. A steel sheet for use as an electrode-supporting frame member shall be good of magnetic property, adhesiveness of a black film to a steel substrate and keep a high tensile force necessary for stretching color selecting electrode elements, due to such a structure, quite sensitive to affections derived from reduction of the stretching tensile force as noted in resonance with acoustic waves from a speaker, that the frame member is integrated with color selecting electrode members having striped slits for passage of electron beams formed therein.

The frame member is exposed to a high-temperature atmosphere during blackening treatment under the condition that a bending stress for stretching electrode elements is applied thereto. If a steel sheet lacks in strength at the high temperature, stress relaxation occurs in the frame member. In this point of view, the inventors have researched steel sheets belonging to low-cost common steels but which are excellent in magnetic property, having good adhesiveness of a black film to a steel substrate, and strong at both a room temperature and a high temperature necessary for the frame member.

As a result of our research on various properties of common steels such as thermal expansion, strengthening and high-temperature strength, the inventors have found that addition of Cr together with one or more of Ti, Nb and V and/or one or more of Cu, Ni, Mo, W and B to a low-C steel remarkably strengthens the steel and also increases its high-temperature strength when the steel is subjected to blackening treatment. The increase of strength at both a room temperature and a high temperature suppresses reduction of a tensile force for stretching color selecting electrode elements, so as to provide a steel sheet suitable for a frame member which diminishes color dislocation caused by thermal expansion thereof.

When the new steel sheet is used as material for a frame member for stretching electrode elements, the frame member exhibits sufficient strength at a high temperature so as to suppress reduction of a tensile force for stretching the electrode elements in a state subjected to a heat cycle in a manufacturing process. The steel sheet also has a magnetic property, formability and a blackening, property suitable for the frame member.

Strength at a room temperature, formability, weldability in addition to the high-temperature strength suitable for the frame member of the aperture grill-type color picture tube are bestowed to the steel sheet by manufacturing the steel sheet under conditions specified by the newly proposed method.

DETAILED DESCRIPTION OF THE PREFERRED EMBODIMENTS

Figure 1:
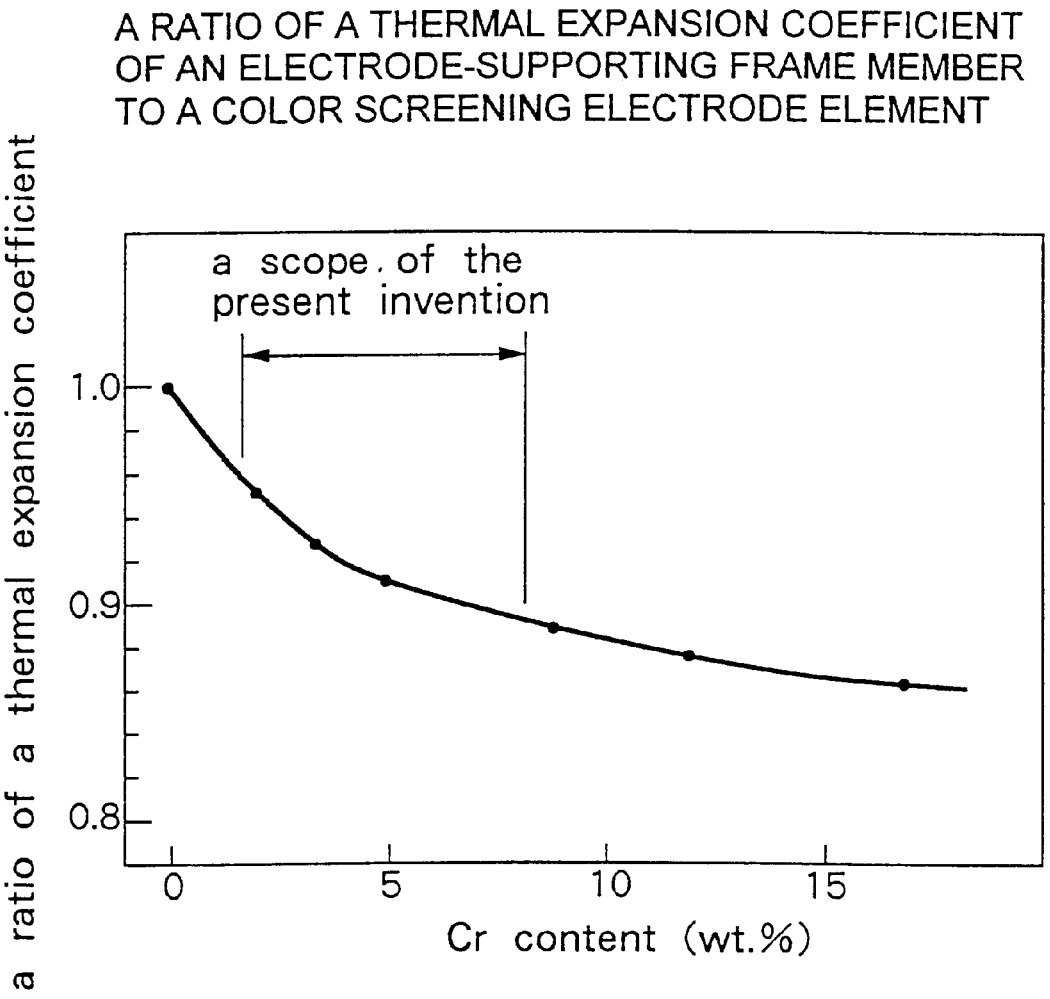
FIG. 1 is a graph which shows an effect of Cr content on a ratio of a thermal expansion coefficient of an electrode-supporting frame member to that of a color selecting electrode element.

The new steel sheet for use as an electrode-supporting frame member of an aperture grill-type color picture tube contains C, Si, Mn, P, S, Cr, Al, Al and at least one of Ti, Nb and V as essential elements. The steel sheet may further contain at least one of Cu, Ni, Mo, W and B. The effects of these alloying elements will be apparent from the following explanation.

C: 0.003–0.10 wt. %

C is an alloying element for effectively increasing strength of a steel sheet. The effect of C on increase of strength is realized by addition in an amount of 0.003 wt. % or more, for example 0.003–0.027 wt. %. But, excessive addition of C more than 0.10 wt. % unfavorably deteriorates formability and weldability of a steel sheet.

Si: not more than 1.0 wt. %

Si is added to a steel as a deoxidizing agent but it also effectively improves strength of a steel sheet. But, excessive addition of Si more than 1.0 wt. % causes poor external appearance of a steel sheet and also poor adhesiveness of a black film formed on the steel sheet.

Mn: 0.05–1.5 wt. %

Mn serves as a deoxidizing agent and improves strength of a steel sheet. The addition of Mn is also effective for inhibition of high-temperature embrittlement due to stabilization of inevitably included S as MnS. These effects are apparently noted by addition of Mn in amount of 0.05 wt. % or more. But, excessive addition of Mn more than 1.5 wt. % deteriorates formability and weldability of a steel sheet.

P: not more than 0.10 wt. %

P is effective for improving strength of a steel sheet but is likely segregated at grain boundaries in a steel matrix. When a steel sheet contains excessive amount of P, the steel sheet has strength varied over a broad range and poor formability. In this regard, P content is necessarily controlled not more than 0.10 wt. %, preferably 0.04 wt. % or less.

S: not more than 0.02 wt. %

S is a harmful element which exists as inclusions such as MnS in a steel matrix and reduces formability of a steel sheet. In this regard, it is favorable to reduce S content to the lowest possible level not more than 0.02 wt. %.

Cr: 1.5–8.0 wt. %

Cr is solved or precipitated as a carbide in a steel matrix, resulting in increase of a high-temperature strength effective for enhancing a tensile force for stretching electrode elements. The addition of Cr is also effective for decrease of thermal expansion. In order to inhibit color dislocation caused by thermal expansion, a thermal expansion coefficient of a frame member is necessarily adjusted less than 0.97 times a thermal expansion coefficient of electrode elements. Color dislocation originated in thermal expansion of the frame member is diminished by decreasing the thermal expansion coefficient of the frame member. If a ratio of the thermal expansion coefficient of the frame member to that of the electrode elements is more than 0.97, an effect for a practical use is not realized.

The thermal expansion coefficient of the frame member is controlled by addition of Cr in amount of 1.5 wt. % or more taking into consideration relationship of Cr content with the thermal expansion coefficient as shown in FIG. 1. However, excessive addition of expensive Cr in amount more than 8.0 wt. % unfavorably raises a cost of a steel sheet and also causes poor productivity.

Al: 0.003–0.10 wt. %

Al serves as a deoxidizing agent and stabilizes inevitably included N as AlN. These effects are realized by addition of Al in amount of 0.003 wt. % or more. However, excessive addition of Al in amount more than 0.10 wt. % causes surface defects on a steel sheet and reduces adhesiveness of a black film formed on the steel sheet.

Ti, Nb, V: each 0.08–0.40 wt. %

These elements promote precipitation of carbides in a steel matrix and minimize crystal grains, so as to improve both a room-temperature strength and a high-temperature strength necessary for increase of a tensile force for stretching electrode elements. These effects are typically noted by addition of at least one of Ti, Nb and V in amount of 0.08 wt. % or more. However, excessive addition of these elements in amount more than 0.40 wt. % causes poor formability and weldability.

Cu: up to 2.0 wt. %

Cu is an optional alloying element which is dissolved or precipitated in a steel matrix, so as to enhance a room-temperature strength and a high-temperature strength, resulting in increase of a tensile force for stretching electrode elements. However, excessive addition of Cu in amount more than 2.0 wt. % causes poor formability and poor weldability.

Ni: up to 2.0 wt. %

Ni is an optional alloying element which effectively inhibits high-temperature embrittlement caused by Cu. The effect of Ni on inhibition of high-temperature embrittlement is apparently noted, when Ni content is adjusted to a half or more of Cu content. The additive Ni is also effective for increase of a tensile force for stretching electrode elements, since both a room-temperature strength and a high-temperature strength are enhanced by dissolution and precipitation of Ni in a steel matrix. However, Ni content is preferably adjusted to 2.0 wt. % or less; otherwise excessive use of expensive Ni would increase a cost of a steel sheet.

Mo, W: each 0.01–1.0 wt. %

Mo and W are optional alloying elements which are dissolved or precipitated as fine carbides in a steel matrix, so as to enhance both a room-temperature strength and a high-temperature strength, resulting in increase of a tensile force for stretching electrode elements. These effects are apparently noted by addition of Mo or W in amount of 0.01 wt. % or more. However, excessive addition of Mo or W in amount more than 1.0 wt. % unfavorably increases a cost of a steel sheet and also causes poor formability and weldability.

B: 0.0003–0.0050 wt. %

B is an optional alloying element which strengthens grain boundaries effectively for improvement in rolling ability of a steel strip and stabilizes inevitably included N as BN in a steel matrix. These effects are realized by addition of B in amount of 0.0003 wt. % or more, but saturated at 0.0050 wt. % B.

A steel having the specified composition is hot-rolled and skin-pass rolled. A steel strip is pickled before or after the skin-pass rolling. The pickled steel strip may be further cold-rolled, finally annealed and then skin-pass rolled.

Hot-Rolling

A steel is principally hot-rolled at a finishing temperature just above its $Ar_3$ transition temperature in order to minimize crystal grains. The finishing temperature is preferably controlled in a range of 820–950° C. If the finishing temperature is lower than 820° C., the steel is hot-rolled in an phase-$\alpha$ zone. If the finishing temperature is higher than 950° C., the steel is hot-rolled in a phase-$\lambda$ zone. In any case, crystal grains in the hot-rolled steel strip are coarse.

The hot-rolled steel strip is coiled at a temperature of 400–700° C. The coiling temperature effects a shape and properties of the steel strip. If the coiling temperature is lower than 400° C., the obtained steel strip has a poor shape. On the other hand, the coiling temperature higher than 700° C. causes poor strength of the obtained steel strip and also poor performance in pickling.

Cold-Rolling

A hot-rolled steel strip is optionally cold-rolled in succession. Although there are no discriminative restrictions on cold-rolling, a rolling ratio is preferably controlled at 40% or greater. If the steel strip is cold-rolled at a rolling ratio less than 40%, crystal grains grow coarse during annealing in the following step.

Annealing

A cold-rolled steel strip is annealed at a temperature of 650° C. or higher in a zone where recrystallization is completed. However, an annealing temperature above 950° C. causes occurrence of coarse grains. By the annealing, the steel strip is conditioned to a metallurgical structure free from unrecrystallized grains. Due to the conditioned structure, an obtained steel sheet is improved in formability. If a steel sheet having a structure including unrecrystallized grains is formed to a frame member, it is difficult to keep a shape necessary for the purpose.

Skin-Pass Rolling

A hot-rolled or cold-rolled steel strip is reformed to a flat shape by skin-pass rolling. Skin-pass rolling is favorably performed with a ratio of elongation of approximately 1% or more to assure the flat shape. Skin-pass rolling at a greater ratio of elongation promotes formation of fine precipitates such as MoC, WC and Cu due to introduction of dislocations. The fine precipitates serve as inhibitors against movement of dislocations. Consequently, a high-temperature strength of a steel sheet is improved by stress-relief annealing which is performed after the steel sheet is formed, welded and fabricated to a frame member. However, an excessively greater ratio of elongation decreases formability of an obtained steel sheet. In this regard, a ratio of elongation during skin-pass rolling is preferably controlled to 7% or lower.

EXAMPLE

Each slab having composition shown in Table 1 was hot-rolled under conditions defined in Table 2, skin-pass rolled at a ratio of elongation of 1.5% and then pickled. Steel strips Nos. 8 and 9 were further cold-rolled, annealed and skin-pass rolled at a ratio of elongation of 1.5%.

A test piece regulated as No. 5 in JIS Z 2201 was sampled along a rolling direction from each steel strip and offered to a tensile test at a room temperature regulated in JIS Z 2241. Another test piece cut off each steel strip was subjected to 30 min. stress relief annealing at 550° C. and then offered to tensile tests at a room temperature regulated in JIS Z 2241 and at 450° C. regulated in JIS Z 2272. Results are shown in Table 3.

TABLE 1

STEEL SHEETS USED IN EXAMPLE

| NO. OF | ALLOYING COMPONENTS AND CONTENTS (wt %) | | | | | | | | | | | | | | | |
|---|---|---|---|---|---|---|---|---|---|---|---|---|---|---|---|---|
| STEEL | C | Si | Mn | P | S | Cu | Ni | Cr | Mo | W | Al | B | Ti | Nb | V | NOTE |
| 1 | 0.031 | 0.03 | 0.30 | 0.007 | 0.012 | 0.01 | 0.02 | 1.96 | 0.42 | — | 0.034 | — | 0.16 | — | — | PRESENT |
| 2 | 0.027 | 0.02 | 0.33 | 0.010 | 0.011 | 0.02 | 0.02 | 3.36 | — | — | 0.037 | — | 0 16 | — | 0.14 | INVENTION |
| 3 | 0.016 | 0.01 | 0.49 | 0.011 | 0.008 | 0.02 | 0.04 | 5.06 | — | — | 0.043 | — | 0.15 | — | 0.09 | |
| 4 | 0.018 | 0.01 | 0.38 | 0.008 | 0.009 | 0.01 | 0.03 | 7.62 | — | — | 0.042 | — | — | 0.19 | — | |
| 5 | 0.017 | 0.02 | 0.81 | 0.011 | 0.011 | 0.03 | 0.01 | 3.41 | 0.34 | — | 0.023 | 0.0006 | 0.21 | — | — | |
| 6 | 0.018 | 0.03 | 0.46 | 0.012 | 0.013 | 0.07 | 0.02 | 3.42 | — | 0.28 | 0.054 | — | 0.23 | — | — | |
| 7 | 0.020 | 0.01 | 0.53 | 0.013 | 0.009 | 0.03 | 0.03 | 3.39 | — | 0.07 | 0.035 | — | 0.29 | — | 0.10 | |
| 8 | 0.014 | 0.02 | 0.49 | 0.006 | 0.007 | 0.14 | 0.11 | 3.86 | 0.21 | — | 0.037 | — | 0.08 | 0.11 | — | |
| 9 | 0.007 | 0.63 | 0.50 | 0.029 | 0.007 | 0.02 | 0.06 | 3.83 | 0.09 | 0.03 | 0.052 | — | — | 0.21 | 0.15 | |
| 10 | 0.013 | 0.04 | 0.62 | 0.010 | 0.006 | 1.32 | 1.18 | 3.46 | — | — | 0.039 | 0.0015 | 0.27 | — | — | |
| 11 | 0.086 | 0.02 | 0.29 | 0.009 | 0.008 | 0.01 | 0.02 | 0.02 | — | — | 0.042 | — | 0.10 | — | — | COMPARATIVE |
| 12 | 0.026 | 0.01 | 0.62 | 0.015 | 0.011 | 0.03 | 0.03 | 1.11 | — | — | 0.049 | — | — | — | — | EXAMPLE |
| 13 | 0.020 | 0.47 | 0.40 | 0.010 | 0.007 | 0.09 | 0.06 | 12.1 | — | — | 0.015 | — | 0.06 | — | — | |
| 14 | 0.056 | 0.66 | 0.68 | 0.008 | 0.008 | 0.12 | 0.10 | 17.3 | — | — | 0.027 | — | — | — | — | |

TABLE 2

MANUFACTURING CONDITION OF EACH STEEL SHEET

| NO. OF | HOT ROLLING STEP | | | COLD ROLLING - ANNEALING STEP | | | |
|---|---|---|---|---|---|---|---|
| | hot rolling | | thickness | cold rolling | continuous annealing | thickness | |
| STEEL | finishing temp., ° C. | coiling temp., ° C. | mm | rolling ratio, % | annealing temp., ° C. | mm | NOTE |
| 1 | 920 | 600 | 4.5 | — | — | — | PRESENT |
| 2 | 900 | 550 | 4.5 | — | — | — | INVENTION |
| 3 | 860 | 550 | 4.5 | — | — | — | |
| 4 | 840 | 600 | 4.5 | — | — | — | |
| 5 | 900 | 550 | 4.5 | — | — | — | |
| 6 | 900 | 650 | 4.5 | — | — | — | |
| 7 | 900 | 550 | 4.5 | — | — | — | |
| 8 | 880 | 550 | 6.0 | 60 | 880 | 2.4 | |
| 9 | 880 | 550 | 6.0 | 65 | 850 | 2.1 | |
| 10 | 900 | 460 | 4.5 | — | — | — | |
| 11 | 880 | 500 | 4.5 | — | — | — | COMPARATIVE |
| 12 | 920 | 600 | 4.5 | — | — | — | EXAMPLE |
| 13 | 850 | 680 | 4.5 | — | — | — | |
| 14 | 820 | 630 | 4.5 | — | — | — | |

TABLE 3

MECHANICAL PROPERTIES OF OBTAINED STEEL SHEETS

| NO. OF STEEL | RESULTS OF TENSILE TESTS yield strength N/mm$^2$ | tensile strength N/mm$^2$ | elongation % | AFTER ANNEALED* yield strength N/mm$^2$ | yield strength at 450° C., N/mm$^2$ | |
|---|---|---|---|---|---|---|
| 1 | 386 | 495 | 29.4 | 390 | 274 | PRESENT INVENTION |
| 2 | 436 | 514 | 28.6 | 445 | 285 | |
| 3 | 413 | 498 | 32.4 | 408 | 312 | |
| 4 | 476 | 551 | 27.2 | 501 | 316 | |
| 5 | 436 | 533 | 28.1 | 457 | 327 | |
| 6 | 463 | 566 | 26.4 | 465 | 303 | |
| 7 | 435 | 512 | 30.8 | 423 | 294 | |
| 8 | 431 | 507 | 27.1 | 463 | 314 | |
| 9 | 452 | 525 | 25.6 | 497 | 348 | |
| 10 | 463 | 539 | 26.8 | 521 | 381 | |
| 11 | 274 | 384 | 37.4 | 243 | 138 | COMPARATIVE EXAMPLE |
| 12 | 237 | 331 | 40.3 | 218 | 131 | |
| 13 | 325 | 453 | 39.6 | 321 | 222 | |
| 14 | 338 | 495 | 33.8 | 327 | 242 | |

*The values of yield strength are of steel sheets which were stress-relief annealed.

It is noted from Table 2 that steel sheets according to the present invention satisfy requisitions for use as an electrode-supporting frame member of a color picture tube.

On the other hand, steel sheets Nos. 11 and 12 had poor strength at both a room temperature and a high temperature due to less Cr contents, i.e. 0.05 wt. % and 1.11 wt. %, respectively. A thermal expansion coefficient of a frame member made from the steel sheet containing Cr in such less amount was higher than 0.97 times a thermal expansion coefficient of color selecting electrode elements, as shown in FIG. 1. Due to these inferiority, the steel sheets Nos. 11 and 12 were not favorable material for a frame member. As shown in FIG. 1, an embodiment of the present invention is demonstrated when the Cr content is 1.5 wt. %, the ratio of the thermal expansion coefficient of the electrode supporting frame member to that of electrode elements is 0.97, and when the Cr content is 8.0 wt. %, the ratio is 0.90.

Steel sheets Nos. 13 and 14 had high strength at both a room temperature and a high temperature. However, these steel sheets were expensive ferritic stainless steel which contained Cr in amount exceeding a range of Cr content defined by the present invention.

A steel sheet according to the present invention as aforementioned exhibits high strength at a room temperature as well as at a high temperature after stress-relief annealing. The steel sheet is useful as an electrode-supporting frame member of a color picture tube, due to small reduction of a tensile force for stretching color selecting electrode elements and also suppression of color dislocations caused by thermal expansion of the frame member. In addition, the steel sheet is cheaper than a ferritic stainless steel sheet, since Cr content is controlled at a lower level. Consequently, the steel sheet is suitable for an aperture grill-type color picture tube as well as a shadow mask-type color picture tube. Moreover, the steel sheet sufficiently meets with the development of color picture tubes designed for a large-sized or high definition television set.

What is claimed is:

1. An electrode supporting frame member of a color picture tube made from a steel comprising 0.003–0.027 wt. % C, not more than 1.0 wt. % Si, 0.05–1.5 wt. % Mn, not more than 0.10 wt. % P, not more than 0.02 wt. % S, 1.5–8.0 wt. % Cr, 0.003–0.10 wt. % Al, at least one of 0.08–0.40 wt. % Ti, 0.08–0.40 wt. % Nb and 0.08–0.40 wt. % V, the balance being essentially Fe except inevitable impurities and no Mo; wherein the color picture tube has color selecting electrode elements and the ratio of the thermal expansion coefficient of the electrode supporting frame member to that of the electrode elements is in the range of 0.90 to 0.97.

2. The electrode supporting frame member of a color picture tube as claimed in claim 1 further comprising at least one of up to 2.0 wt. % Cu, up to 2.0 wt. % Ni, 0.01–2.0 wt. % W and 0.0003–0.005 wt. % B.

* * * * *

UNITED STATES PATENT AND TRADEMARK OFFICE

CERTIFICATE OF CORRECTION

PATENT NO. : 6,544,356 B2
DATED : April 8, 2003
INVENTOR(S) : Yukio Katagiri et al.

It is certified that error appears in the above-identified patent and that said Letters Patent is hereby corrected as shown below:

Title page, Item [54] and Column 1, lines 4 and 5,
Title, delete "AND MANUFACTURING METHOD THEREOF"

Column 1,
Line 21, "grill type" should read -- grill-type --.

Signed and Sealed this

Twentieth Day of April, 2004

JON W. DUDAS
*Acting Director of the United States Patent and Trademark Office*